US006908051B2

(12) United States Patent
Michael

(10) Patent No.: US 6,908,051 B2
(45) Date of Patent: Jun. 21, 2005

(54) SELF-ALIGNING, SPRING-DISK WATERJET ASSEMBLY

(76) Inventor: McDonald C. Michael, 2605 210th Ave. E., Sumner, WA (US) 98390

( * ) Notice: Subject to any disclaimer, the term of this patent is extended or adjusted under 35 U.S.C. 154(b) by 152 days.

(21) Appl. No.: 10/309,787

(22) Filed: Dec. 3, 2002

(65) Prior Publication Data

US 2003/0132325 A1 Jul. 17, 2003

Related U.S. Application Data

(63) Continuation-in-part of application No. 09/866,350, filed on May 25, 2001, now Pat. No. 6,488,221.

(51) Int. Cl.[7] ..... B05B 1/00; B05B 1/30

(52) U.S. Cl. ..... 239/596; 239/597; 239/600; 239/533.14

(58) Field of Search ..... 239/596, 597, 239/600, 533.9, 533.14, 533.1

(56) References Cited

U.S. PATENT DOCUMENTS

| | | | | |
|---|---|---|---|---|
| 3,705,693 A | | 12/1972 | Franz | |
| 3,756,106 A | | 9/1973 | Chadwick et al. | |
| 3,997,111 A | | 12/1976 | Thomas et al. | |
| 4,150,794 A | | 4/1979 | Higgins | |
| 4,162,763 A | | 7/1979 | Higgins | |
| 4,534,427 A | * | 8/1985 | Wang et al. | 175/67 |
| 4,660,773 A | | 4/1987 | O'Hanlon | |
| 4,768,709 A | * | 9/1988 | Yie | 239/8 |
| 4,836,455 A | | 6/1989 | Munoz | |
| 4,852,800 A | | 8/1989 | Murdock | |
| 4,936,512 A | | 6/1990 | Tremoulet, Jr. | |
| 5,018,670 A | | 5/1991 | Chalmers | |
| 5,199,640 A | | 4/1993 | Ursic | |
| 5,730,358 A | | 3/1998 | Raghavan et al. | |
| 5,794,854 A | * | 8/1998 | Yie | 239/242 |
| 5,848,753 A | | 12/1998 | Wands et al. | |
| 6,488,221 B1 | * | 12/2002 | McDonald | 239/596 |

* cited by examiner

*Primary Examiner*—Davis Hwu
(74) *Attorney, Agent, or Firm*—R. Reams Goodloe, Jr.

(57) ABSTRACT

An orifice holding spring disk. The spring disk is utilized to retain orifice(s) against a smooth flat platen surface. The spring disk may further comprise an inlet flow conditioning nozzle, provided in (a) a flow collimating configuration to produce a coherent flow waterjet, or (b) in a de-collimating configuration to produce a divergent waterjet. The spring disk has an annular outer ring, one or more through-holes, and counterbores to form wells in the spring disk. The wells are slightly larger in diameter than the particular orifice to be mounted and slightly shallower (in the water flow direction) than the thickness of the orifice. A nozzle cap compresses the platen and spring disc against a high pressure inlet tube. The outer diameter of the spring disk is forced to flex to the cap surface while the center portion is restrained by the orifice that is resting on the platen.

38 Claims, 11 Drawing Sheets

SELF-ALIGNING, SPRING-DISK WATERJET ASSEMBLY

RELATED PATENT APPLICATIONS

This application is a continuation-in-part of application Ser. No. 09/866,350, filed May 25, 2001 now U.S. Pat. No. 6,488,221.

TECHNICAL FIELD

The invention disclosed and claimed herein relates generally to high-pressure fluid jet nozzles, and more particularly to orifice jet nozzle assemblies for waterjet cutting systems and the like that use high-pressure fluids to form a high-energy stream for material cutting and other processes.

BACKGROUND

In high-pressure fluid jet nozzles, and more particularly in an orifice jet nozzle assembly for waterjet cutting systems, the proper alignment of the orifice insert that forms the water stream is essential to proper function and accurate cutting. The orifice insert must also be replaced at frequent intervals. The process of orifice insert installation and alignment takes time and cannot be done by machine operators under field conditions. It would be advantageous to provide a waterjet assembly which has a design that allows for easy installation and alignment of orifices by operating waterjet system personnel.

Furthermore, all prior art waterjet systems known to me provide only for a single orifice per nozzle. It would be advantageous to provide a waterjet assembly which has a design that allows for multiple orifices from a single nozzle, to thus allow multiple waterjets from a single nozzle.

Also, it would be desirable to be able to quickly and easily adjust the flow pattern of a waterjet as may be most desirable for a particular job at hand. For example, a very narrow, coherent, collimated waterjet stream is desirable for water only cutting or cleaning use, whereas a spreading, slightly decollimating waterjet may be useful when cutting using abrasives, for example. In cutting applications, undesirable spreading of the waterjet increases the width of the kerf in the workpiece, and in some applications, may result in undesirable exposure of adjacent surfaces to the waterjet.

Accordingly, it can be appreciated that it would be desirable to provide an apparatus and a convenient method of employing such apparatus that (a) would allow easy replacement and alignment of orifices by field personnel, (b) would allow easy adjustment of the flow pattern provided in a waterjet device, and (c) would allow multiple orifices to be utilized in a single nozzle.

SUMMARY

Certain embodiments of the present invention use a spring device, advantageously provided in the form of a spring disk, to retain and align an orifice, or orifices, on a smooth flat surface. Such a spring device, when in disk form, has a large outside diameter, one or more through-holes (apertures), which in one embodiment may be circular holes, in the general area at or near the axial center the spring disk. In those locations where orifices are to be mounted, then provided concentric with the through-holes are shallow recesses (or counterbores) to form wells in the spring disk, and wherein each well has an upper shoulder portion which acts against an edge portion of the upper surface of the orifice to position and secure the orifice in a desired working location. The wells are slightly larger in diameter than the particular orifice to be mounted and slightly shallower (in the water flow direction) than the thickness of the orifice. The orifice or orifices, as the case may be, are placed into the recesses (counterbores). When installing an orifice, a small amount of a viscous liquid, such a water with soap, will prevent the orifices from falling out of the recess(es). A lapped platen having one or more through holes for accommodating passage of a waterjet therethrough are provided for receipt there against of the spring disk. A nozzle cap is provided with a locating recess or other locating feature that has a diameter that is slightly larger then the platen, and which has through-holes that are concentric with the orifice hole(s). The surface of the platen is lapped so that it is very flat and smooth. The diameter of the spring disk is larger than the inner diameter of the platen. When the nozzle cap is mounted on the inlet tube and tightened, an annular area adjacent the circumference of the spring disk is forced to flex to the platen surface while the center portion of the spring disk is restrained by the orifice that is resting on the same platen surface. This imposes a force (a preload) on the orifice(s) which acts on the lapped surface of the platen. The force on the orifice(s) is a function of the diameter, thickness, and displacement of the outer portion of the spring disk. However, this force is not sufficient to prevent fluid from leaking around the orifice. The principle that works to provide total sealing, so as to prevent fluid from leaking around the orifice, is a self-actuating concept that uses the difference in area between the top of the orifice and the bottom that is resting on the lapped surface. The hole through the platen is larger than the diameter of the bore through the orifice. The inlet area of the orifice (exposed to high pressure fluid) is larger than the area of the orifice resting on the lapped surface. The resulting effect is that the stress (pounds force per square inch) acting on the orifice at the lapped surface is much greater than the stress (pounds force per square inch) at the inlet area of the orifice. As a result, when the lapped area is smooth, fluid cannot leak past the orifice.

In various embodiments, the spring disk includes a flow conditioning nozzle upstream of the location of the orifice. This flow conditioning nozzle may be a collimating nozzle which serves to provide a more coherent waterjet stream, or a de-collimating nozzle which serves to provide a less coherent waterjet stream.

In another embodiment, the spring disk may be bored and counterbored to secure placement of several orifices at specified distances from each other to provide multiple waterjets for simultaneous cutting.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawing, wherein:

FIG. 17 shows the waterjet stream resulting from the use of de-collimating flow conditioning nozzle, where the waterjet quickly spreads in diameter, to provide a larger jet for mixing with abrasives, or for cleaning a wider path.

FIG. 18 shows the waterjet stream resulting from the use of a collimating flow conditioning nozzle, where the waterjet stream is maintained in a coherent, substantially uniform diameter, collimated stream for an appreciable downstream distance before enlargement of the waterjet stream.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, variations in the elements of the self aligning, spring-disk water jet assembly, especially as applied for different variations of the functional components illustrated, may be utilized in various embodiments in order to provide a robust waterjet orifice alignment structure suitable for a variety of waterjet nozzle designs and applications. Further although the use of terms "upwardly" and "downwardly" and the like may be used for purposes of illustration, it is to be understood that waterjet assemblies may be configured for a variety of orientations, and such terms are used in relative context as an aid in understanding the invention, and shall not be considered to limit the devices disclosed to use in vertical orientations.

DETAILED DESCRIPTION

Figure 1:
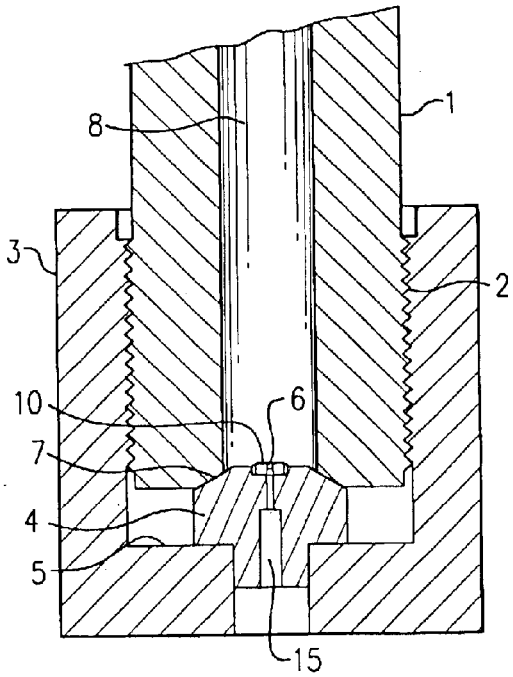
FIG. 1 (PRIOR ART)
FIG. 1 is a cross section of a prior art nozzle assembly.

Attention is directed to FIG. 1, which shows a prior art fluid jet mounting assembly capable of accepting an orifice. As shown in FIG. 1, a piece of high pressure conveyance tubing, designated by the reference numeral 1, is provided with a threaded end 2, onto which a nozzle cap 3 is screwed to secure and hold in place an orifice system 4 between bottom compression lands 5 of the nozzle cap and an alignment and seal taper 7 of the tube 1. For cutting solid material, a cutting fluid, usually water under high pressure, typically above 20,000 psi, is supplied to the interior 8 of the inlet tube 1 and escapes as a focused stream through orifice bore 6 and on through internal bore 15. This concentrated fluid jet $J_1$ (see FIG. 2) performs the cutting process on solid materials.

Figure 2:
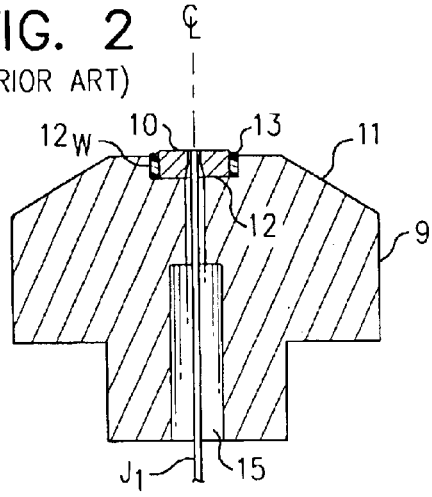
FIG. 2 (PRIOR ART)
FIG. 2 is a cross section of a prior art support system for orifice.

FIG. 2 shows a prior art nozzle which might be installed in the nozzle fixture formed by nozzle tube 1 and nozzle cap 3 of FIG. 1. The nozzle fixture is formed of a body portion 9 having an internal bore 15 provided through the center of the body portion 9. A complementary seal taper 11 cooperates with the taper surface 7 of tube 1 to align and seal the orifice body 9 in the assembly. A typical orifice 10 is shown mounted in counterbore 12 in the orifice body portion 9. A polymer seal 13 material is pressed in to the annulus between the orifice 10 outside diameter and the counterbore 12 wall $12_w$. This retains the orifice 10. Although generally acceptable, this embodiment of the prior art fails to provide a positive means of securing the orifice 10 within the orifice body 9. Due to the high operating pressures and sometimes rapid fluctuations in pressure, an orifice 10 frequently becomes dislodged. In addition, erosion around the orifice 10 has occurred at times thus permitting the orifice 10 to move laterally out of focus or become more easily dislodged from its mounting. Also, in applications using extreme high or low temperature fluids, the polymer seal 13 sometimes fails, resulting in orifice failure.

Figure 3:
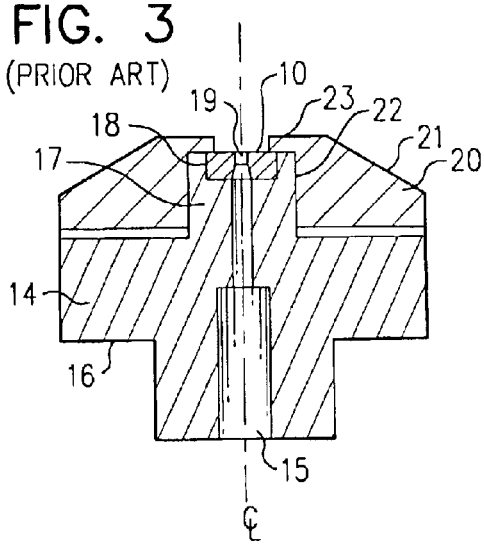
FIG. 3 (PRIOR ART)
FIG. 3 is a cross section of another prior art method for aligning and confining an orifice.

FIG. 3 shows a more recent prior art design in which a mounting body 14 is provided with a central through bore 15, a mounting flange 16 for mating with lands 5 of nozzle cap 3 (see FIG. 1), and a cylindrical head 17 which is further provided with a counterbore 18 which receives an orifice 10 having an orifice bore 19 which aligns axially along the centerline of through bore 15. Also shown is retaining hat 20 with a conical surface 21 and a cylindrical bore 22, which cooperates with cylindrical head 17 by means of an interference fit to secure the conical hat 20 on the cylindrical head 17. The conical hat 20 is further provided with an internal flange 23 which presses on and secures the orifice 10 in the bore 18 of the cylindrical head 17. This prior art device secures the orifice 10 in place and provides alignment for the jet stream. While this prior art design provides for a positive system for securing the orifice, it is a complex and expensive design that requires special tools and does not allow for easy replacement of the orifice 10 by field personnel.

In contrast, a novel orifice support system has been developed, and is disclosed herein, which is mechanically much simpler, which allows easy alignment of an orifice, and which allows the orifice to be replaced by operating field personnel. It should be noted that no special tools or training are required to effect such replacement or alignment. This results in much lower orifice replacement costs. Moreover, this significantly reduces the waterjet cutting system down time.

Figure 4:
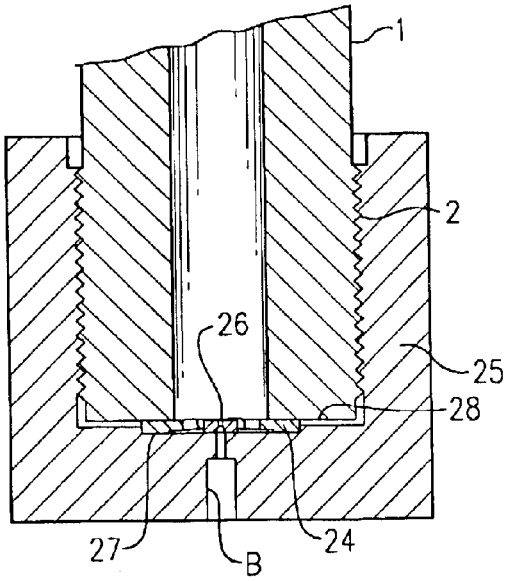
FIG. 4 is a cross section of nozzle assembly for use as taught herein.

FIGS. 4, 5, 6, 7, and 8 refer to one embodiment of a novel orifice support system. FIG. 4 shows a waterjet assembly capable of accepting an orifice. A high pressure inlet tube, designated by the reference numeral 1, is provided with a threaded end 2, onto which a nozzle cap 25 is screwed to secure a spring disk 24 between lapped surface 27 within the nozzle cap 25 and the bottom end 28 of the high pressure inlet tube 1. The spring disk 24 is designed to confine and concentrically align orifice(s) 26 with the throughbore of the spring disk 24 and outlet bore B of the nozzle cap 25.

Figure 5:
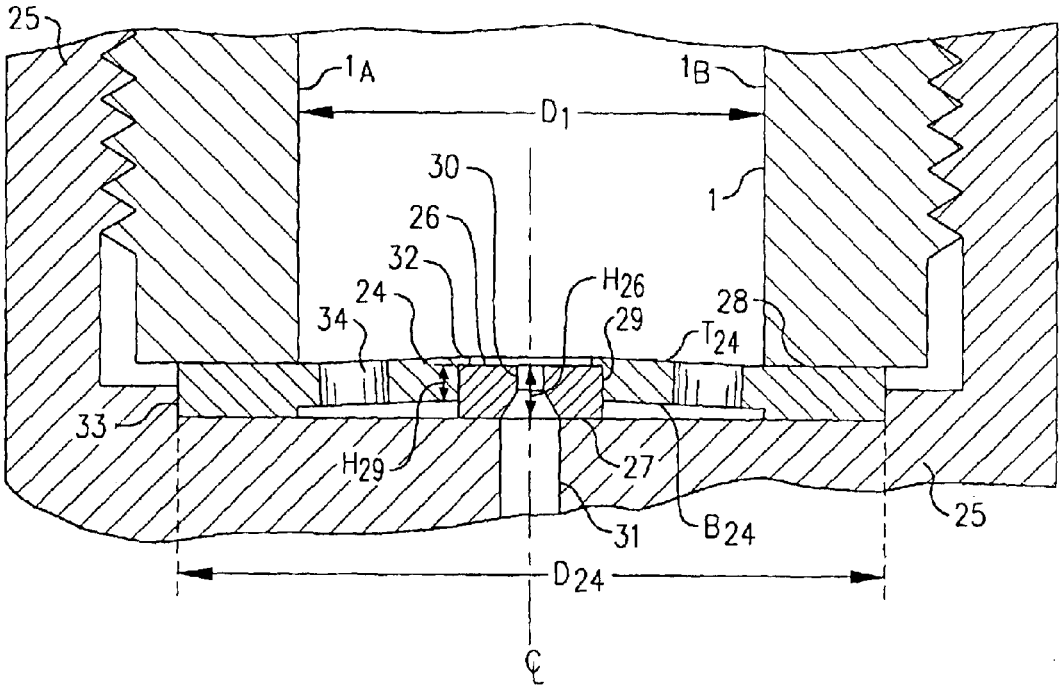
FIG. 5 is a cross section of nozzle cap, inlet tube, spring disk and orifice for use as taught herein.

FIG. 5 shows spring disk 24 with a thickness slightly smaller than the orifice 26. A counterbore 29 receives orifice 26. The orifice 26 has an orifice bore 30. Counterbore (recess) 29 has a vertical depth $H_{29}$ that is smaller than the height $H_{26}$ of the orifice 26. Counterbore 29 aligns axially with bore 31 of the nozzle cap 25. The orifice 26 is restrained by a flange 32 of the spring disk. The nozzle cap 25 is made with a recess (counterbore) 33 that has a height that is smaller than that of the spring disk 24, a diameter that is slightly larger than the spring disk 24, and throughhole(s) 31 that is (are) concentric with the orifice hole 30. The recessed surface 27 of the nozzle cap 25 is lapped so that the surface is flat and smooth. The diameter $D_{24}$ of the spring disk 24 is slightly larger than the diameter $D_1$ of the high pressure inlet tube 1, a defined between sidewalls $\mathbf{1}_A$ and $\mathbf{1}_B$. When the nozzle cap 25 is mounted on the high pressure inlet tube 1 and tightened, the outer diameter of the spring disk 24 is forced to flex to the nozzle cap surface 27 while the center portion is restrained by the orifice 26 which is held in place by flange 32 and which rests on the lapped surface 27 of the nozzle cap 25. This structure and technique secures and aligns the orifice and prevents the possibility of movement or escape of orifice 26. The generally cylindrical center disc portion of the spring disk 24 may contain thru bore(s) 34. The thru bore(s) 34 prevent pressure imbalances from occurring between the upstream side or top $T_{24}$ and the downstream or bottom side $B_{24}$ of the spring disk 24 that could cause over flexing and failure of the spring disk 24. The thru bore(s) 34 are located in the annulus defined between the bore or inside diameter $D_1$ of the inlet tube 1 and the counterbore 29 in which the orifice 26 is held.

Figure 6:
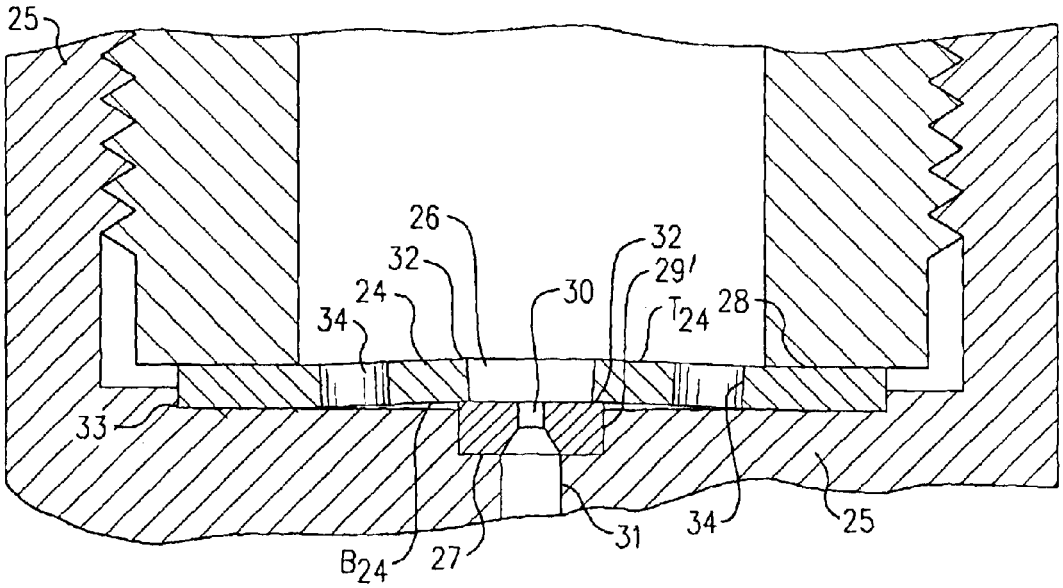
FIG. 6 is a cross section of one embodiment employing a spring disk.

FIG. 6 shows an alternate configuration of the assembly first shown in FIG. 5, now showing where a recess 29' is located in the nozzle cap 25 to secure the orifice 26 in operating position.

Figure 7:
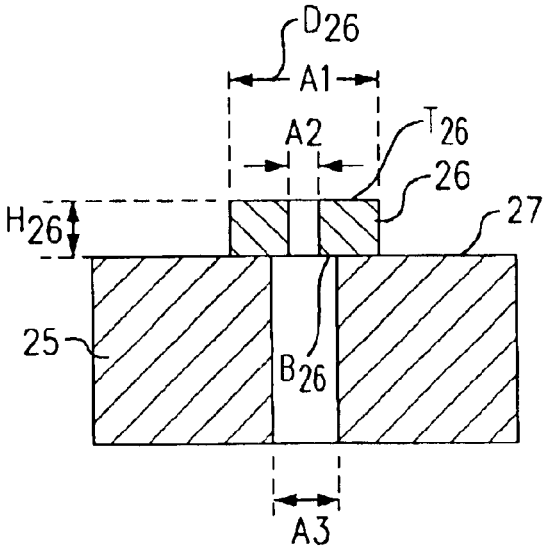
FIG. 7 is a cross section of orifice and nozzle cap for use in accord with the present invention showing principle of difference in high pressure area between the bottom and the top of the orifice which prevents leakage around the orifice.

The operating principle utilized in various embodiments to provided total sealing is illustrated in FIG. 7. It is a self-actuating concept that uses the difference in areas between the top $T_{26}$ and bottom $B_{26}$ surfaces of the orifice 26. Since the stress (pressure, pounds force per square inch) that is acting on each surface is the same, the force acting on the larger area on top $T_{26}$ of the orifice (A1–A2) is much larger than the force acting on the area of the surface in contact with the nozzle cap (A1–A3). As a result, when the nozzle cap surface 27 is lapped and smooth, fluid cannot leak past the orifice 26.

It has been found that suitable material for the spring disk 24 are a number of metals having a degree of corrosion resistance and adequate flexibility to assure proper restraint of the orifice 26 without fracturing it, such as various stainless steel compositions.

Figure 8:
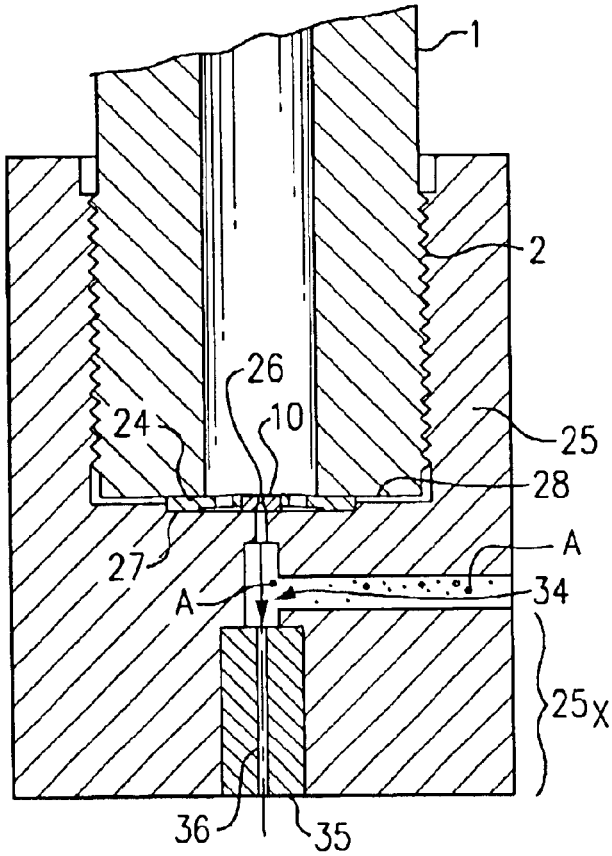
FIG. 8 is a cross section of a typical abrasive waterjet nozzle using the flexible, self-aligning spring disk as taught herein.

FIG. 8 is a cross section of an abrasive waterjet nozzle that has been adapted to utilize a spring disc 24 for securing an orifice 26. An extension $\mathbf{25}_x$ is added to the nozzle cap 25. Abrasive media A flows into a feed port 34 and a mixing tube 35 in located concentric with the through bore 10 of the orifice 26. The abrasive media is entrained after entering through feed port 34 and accelerated in the mixing tube 35 to very high velocities for cutting and cleaning. Alignment of the waterjet stream is very critical to prevent rapid erosion of the mixing tube bore 36. The novel orifice positioning system provide by use of the spring disc 24 concept taught herein can substantially improve nozzle cap 25 life in such applications.

Figure 9:
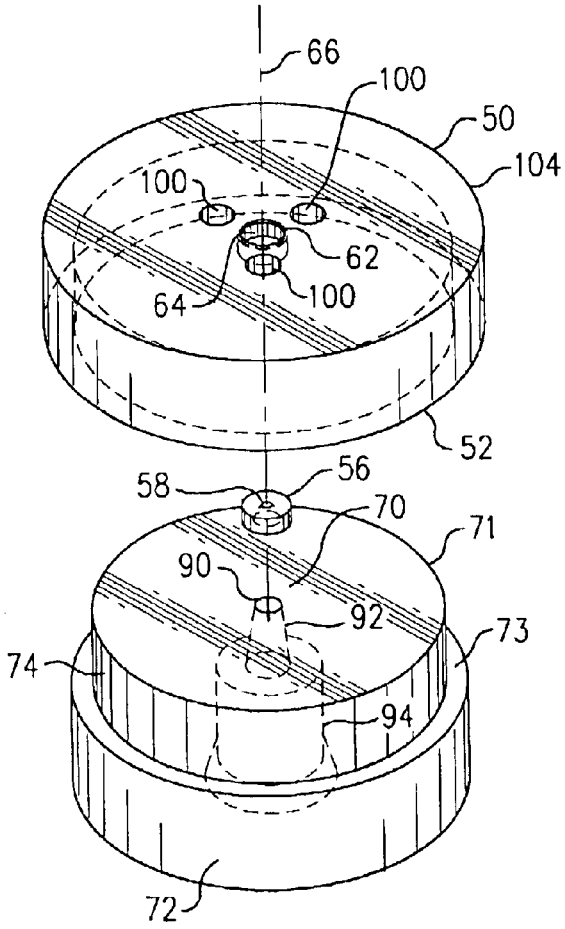
FIG. 9 shows another embodiment of the spring disk; showing here how a smooth, lapped replaceable platen with integral base may be provided for a orifice to act against when trapped in operating position by the retaining ring of the counterbore in the spring disk.
Figure 10:
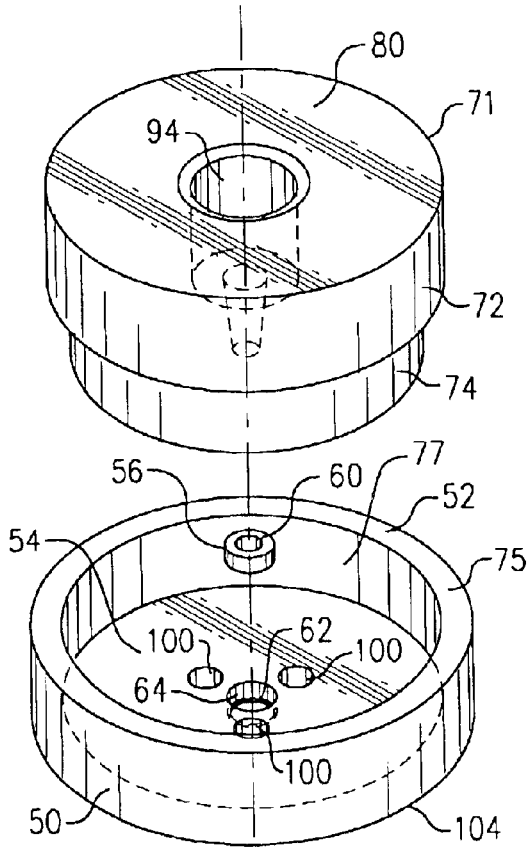
FIG. 10 shows the embodiment just described in FIG. 9, but now showing the apparatus inverted, for more clearly displaying some of the interior components and structure.

Turning now to FIGS. 9 and 10, another embodiment of a spring disk 50 is illustrated. Here a generally circular spring disk 50 is provided having an integral annular ring shoulder 52 which extends downward from the lower interior side 54 of the spring disk 50 (as better seen in the inverted view provided in FIG. 10). A waterjet orifice 56, having a smooth upper side 58 and a smooth lower side 60 is trapped at its upper side 58 by upper flange portion 62 (a retaining ring lip) located at the upper reaches of counterbore 64 located along the centerline 66 of spring disk 50. Thus, the orifice 56 is retained downward at its lower side 60 against a smooth (preferably lapped) upper orifice receiving surface 70 on replaceable platen 71. The platen 71 is shown with an integral base portion 72. The base portion 72 has an upper ledge 73 and a recessed cylindrical neck 74 shaped and sized for close fitting engagement with bottom surface 75 and vertical surface 77, respectively, of an integral annular shoulder 52 of spring disk 50. In operation, the lower end portion or bottom 80 of the integral base portion 72 (see the inverted view in FIG. 10) is affixed against a platen receiving surface in the nozzle cap as provided by counterbore 82 in nozzle cap 84, in the manner as illustrated with respect to spring disk 50' in FIG. 11. Then, the spring disk 50' is compressed downward against platen 70 to trap orifice 56 securely against the platen, similar to the configuration first shown in FIG. 5, but now with both spring disk 50 and replaceable platen 70 located between nozzle cap 84 and the lower end 86 of the high pressure inlet tube 88. Note that FIG. 10, shows the embodiment just described in FIG. 9, but now showing the apparatus inverted, for more clearly displaying the interior of outlet passageways 90, 92, and 94 through platen 71.

FIGS. 12 and 13, and FIGS. 15 and 16 provide descriptions of alternate embodiments of spring disk 50, namely discs 50' and 50". The spring disc 50' shown in FIGS. 11, 13, and 13 varies from the spring disc 50 in that additional through-holes 100 are provided. Specifically, in FIGS. 9 and 10, 3 through-holes 100 are provided, and in FIGS. 11, 12, 13, 14, 15, and 16, six through holes are provided through the central cylindrical disc portion 102 of spring discs 50' and 50'. The additional through-holes 100 provide additional spring force flexibility, and more specifically, enable more flexure of the spring disc, in the axial, or flow-wise direction, between the axial centerline 66 and the radial edge 104.

Figure 11:
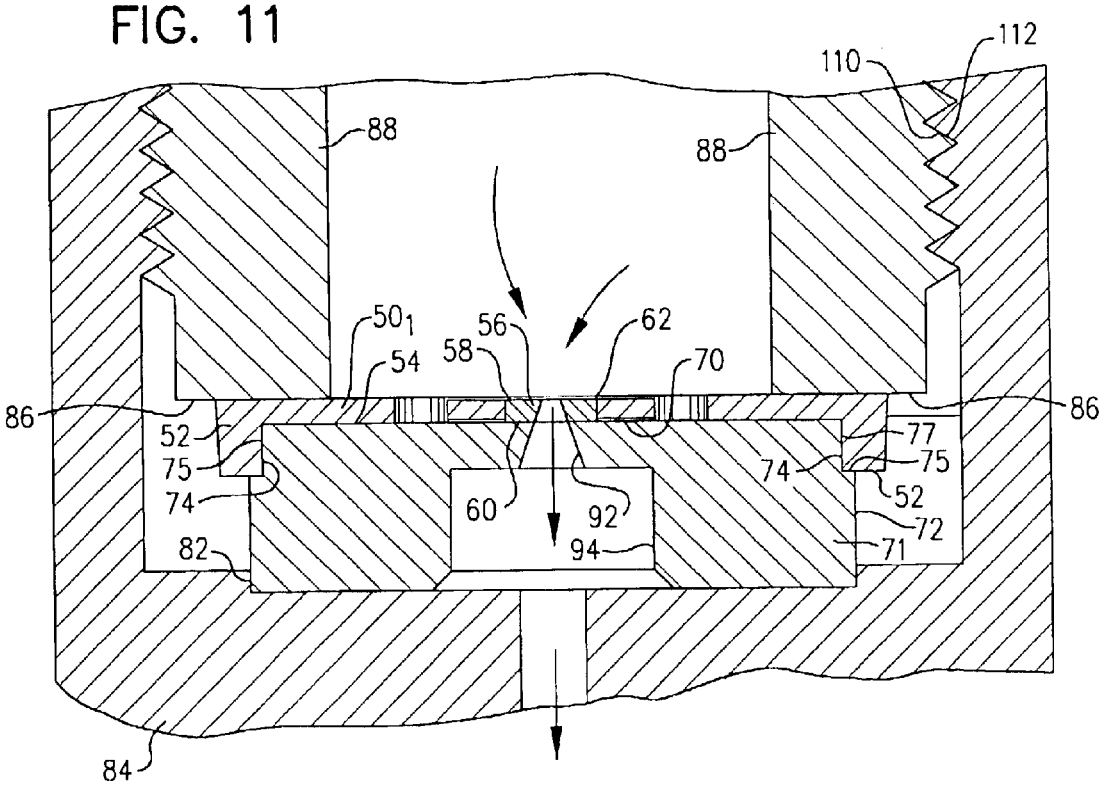
FIG. 11 provides a vertical cross-sectional view of a spring disk mounted against a smooth, lapped replaceable platen so that the orifice is trapped against the platen, showing the spring disk and platen in close mating engagement when urged together between the distal end of a threaded tube and a nozzle cap in a waterjet machine.
Figure 12:
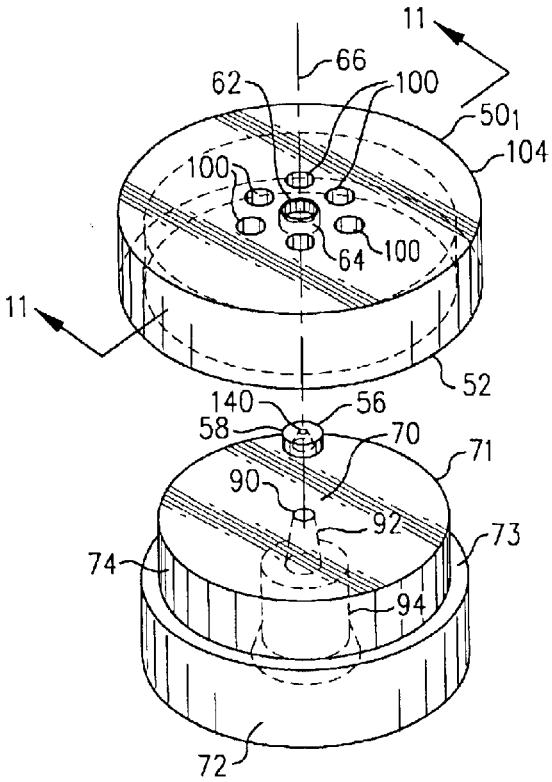
FIG. 12 provides a perspective view of the apparatus just shown in FIG. 11, now showing an exploded view the orifice which mounts in the underside of the spring disk against the remaining ring thereof, as well as showing multiple apertures through the spring disk to allow for sufficient spring action to strongly urge the orifice against the lapped platen.
Figure 13:
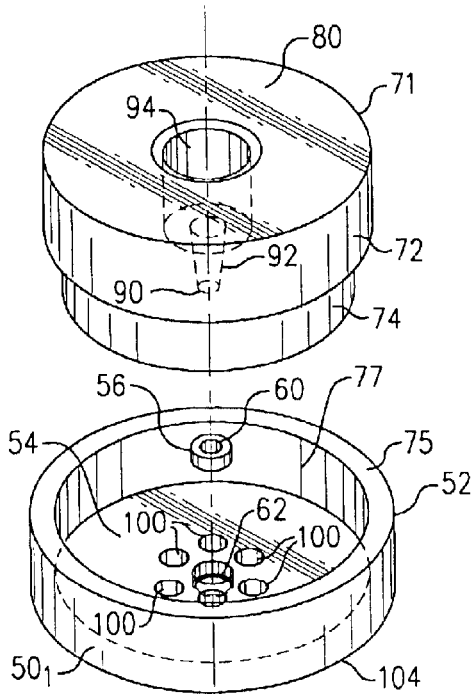
FIG. 13 provides a perspective view of the apparatus just set forth in FIGS. 11 and 12, now showing a bottom perspective view, and again showing the mounting of the orifice in the spring disc.

FIG. 11 provides a vertical cross-sectional view of a spring disk 50', illustrated in perspective in FIGS. 12 and 13, mounted against a smooth upper orifice receiving surface 70 on replaceable platen 71, so that the orifice 58 is trapped against the platen surface 70 on platen 71. This results in the spring disk 50' and platen 71 being in close mating engagement when urged together between the distal, bottom compressive end portion 86 of a threaded 110 high pressure tube 88 and a threaded 112 nozzle cap 84 in a waterjet apparatus. A separate perspective view of the spring disc 50' and replaceable platen 71 assembly just shown in FIG. 11 is provided in FIGS. 12 and 13. In this partially exploded view the orifice 58 is seen, which orifice 58 mounts in the bottom or underside 54 of the spring disk 50' against the upper retaining flange (retaining ring) 62 thereof. Also, as just noted, the multiple apertures or through-holes 100 through the spring disk 50' to allow for sufficient spring action to strongly urge the orifice 58 against the lapped surface 70 of platen 71. Further details of this embodiment are shown in FIG. 13, which provides a bottom perspective view which again shows the mounting of the orifice 58 in the spring disc 50'.

Figure 14:
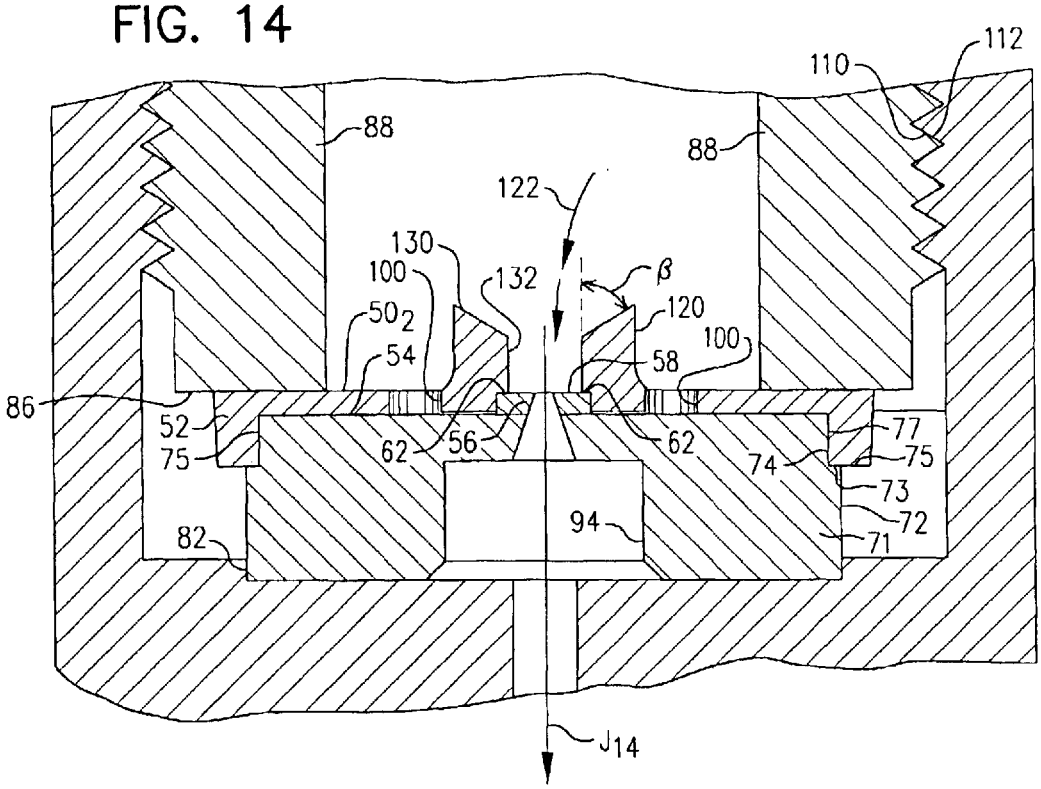
FIG. 14 is a vertical cross-sectional view, similar to that shown in FIG. 11, but now illustrating one embodiment of a spring disc which incorporates a flow conditioning nozzle through which inlet liquid flow is conditioned prior to passage through the orifice.
Figure 15:
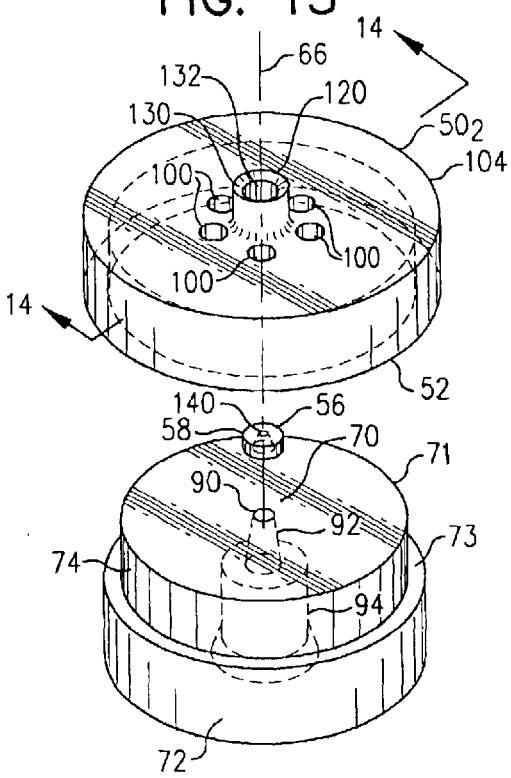
FIG. 15 is a perspective view of the apparatus just shown in FIG. 14, now showing in an exploded view the flow alignment channel through which liquid flow is conditioned prior to passage through the orifice, and also showing an orifice which mounts in the underside of the spring disk against the retaining ring thereof, as well as showing multiple apertures through the spring disk to allow for sufficient spring action to strongly urge the orifice against the lapped platen.
Figure 18:
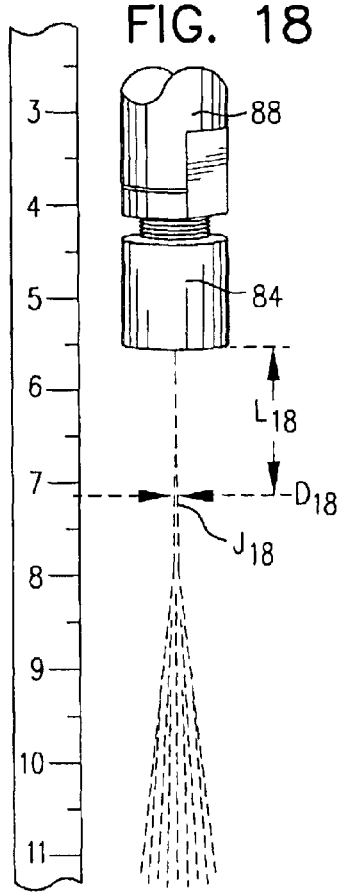
Figure 19:
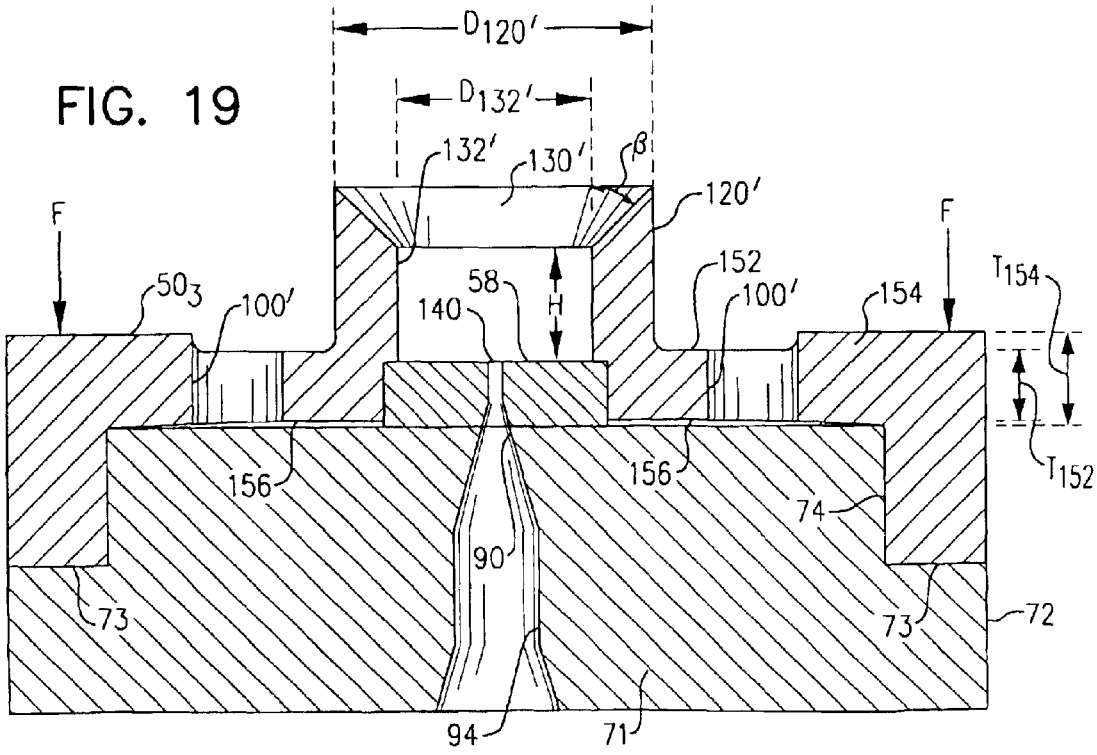
FIG. 19 provides a vertical cross-sectional view, similar to the view first provide in FIG. 14, now showing in further detail the inward sloping inlet wall provided in one embodiment of a collimating type flow conditioning nozzle that produced the coherent waterjet just illustrated in FIG. 18, but further illustrating (unlike the embodiment of FIG. 14) the use of a thinned, radially outward extending spoke region which allow adjustment of spring force exerted against a orifice downward toward a lapped platen surface.
Figure 20:
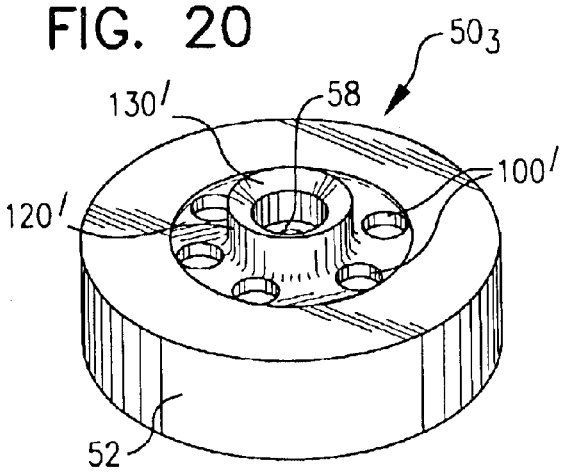
FIG. 20 is a perspective view of the embodiment of a collimating type flow conditioning nozzle just illustrated in FIGS. 18 and 19 above, now showing (unlike the embodiment of FIG. 14) the use of a thinned spoke region which allows adjustment of spring force exerted against an orifice downward toward a lapped platen surface.
Figure 21:
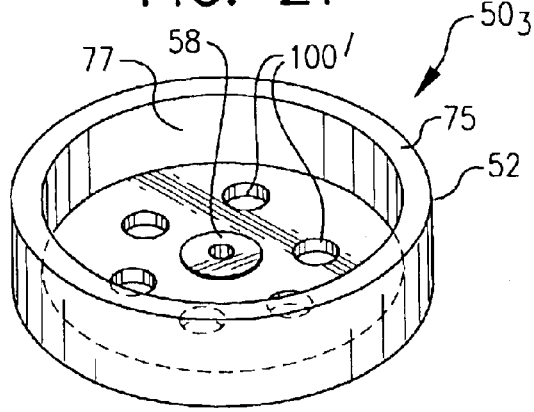
FIG. 21 is a perspective view of the bottom side of the spring disk just illustrated in FIGS. 19 and 20, now showing the outlet of the orifice secured in the center counterbore.
Figure 22:
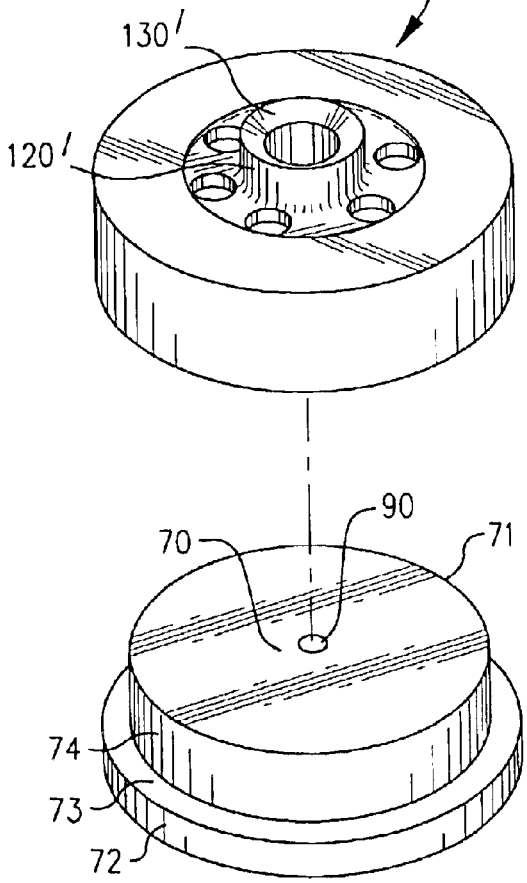
FIG. 22 is a perspective view of he spring disk and platen assembly, similar to the view set forth in FIG. 15, but now shoeing the spring disk with spokes first illustrated in FIG. 19, and showing the spring disk removed from, but resting against the platen, and more clearly showing the vertical sidewalls and the annular receiving edge of the platen along which the annular ringwall of the spring disk interfittingly engages when disk and platen assembly is compressed between the nozzle cap and the distal end of the inlet tube
Figure 23:
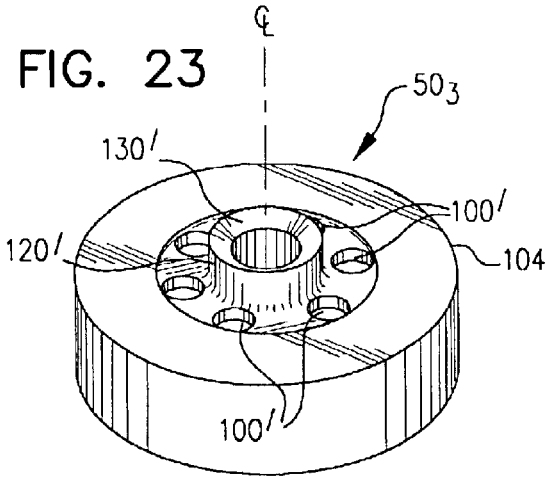
FIG. 23 is yet another perspective view of a spring disc with a flow conditioning nozzle, here showing another view of the collimating type flow conditioning nozzle utilized to provide the collimated, coherent waterjet stream illustrated in FIG. 18.

Attention is now directed to FIG. 14, taken as if across line 14—14 of FIG. 15, where one embodiment of a spring disk 50" which incorporates the use of a flow conditioning nozzle 120 is illustrated in a vertical cross-sectional view. Upper flange portion 62 still is utilized to retain and compress orifice 58 against surface 70 of platen 71. The flow conditioning nozzle through which inlet liquid passes may be configured as desired to condition the inlet liquid stream 122 in order provide a desired waterjet $J_{14}$ shape. For example inlet flowstream 122 can be conditioned prior to passage through the orifice 58 to provide the collimated waterjet stream shape illustrated in FIG. 18, where a coherent waterjet $J_{18}$ is facilitated; as shown in FIG. 18, the waterjet $J_{18}$ diameter is substantially uniform diameter $D_{18}$ for a distance of over an inch, and actually, in excess of one and one-half inches of working distance $L_{18}$ downstream. Note that the collimating type flow conditioning nozzle 120 provided in FIGS. 14 and 15, and similar nozzles provided in FIGS. 19 though 23, utilize a sloping inlet wall 130 or 130' which slopes inwardly and downwardly at an angle beta (β) at a preselected angle, which may be adjusted as necessary based on flow rates, pressures, and other process conditions. However, it has been found that an angle beta (β) of approximately forty five degrees (45°) is useful in creating the results just illustrated in FIG. 18. Accordingly, this FIG. 18 shows a waterjet stream $D_{18}$ resulting from the use of a collimating flow conditioning nozzle 120 that enables the waterjet stream to be maintained in a coherent, substantially uniform diameter, collimated stream for an appreciable downstream working distance $D_{18}$ before enlargement in diameter of the waterjet stream $J_{18}$.

Figure 16:
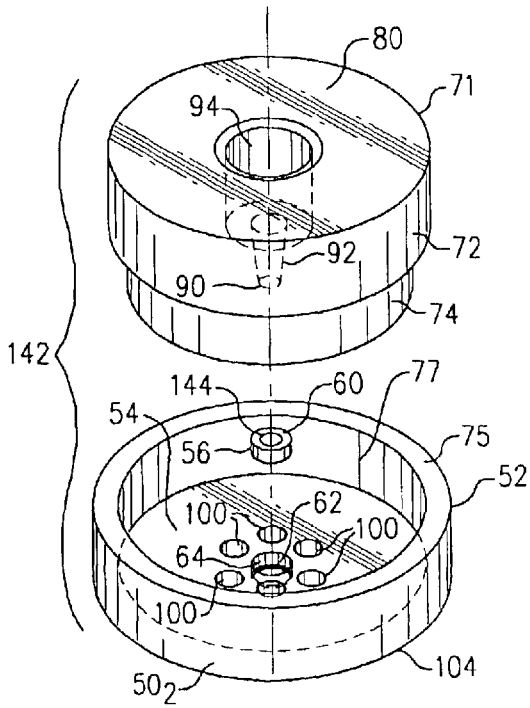
FIG. 16 provides a perspective view of the apparatus just set forth in FIGS. 11 and 12, now showing a bottom perspective view, and again showing the mounting of the orifice in the spring disc, and in this case showing the outlet of the orifice.

FIG. 15 is a perspective view of the apparatus just shown in FIG. 14, now showing in an exploded view the flow alignment channel 132 through which liquid flow is conditioned prior to passage through the passage 140 in orifice 58. Other components are comparable to those just illustrated with respect to FIGS. 12 and 13 above, including the use of multiple apertures 100 through the spring disk to allow for sufficient spring action to strongly urge the orifice 58 against the lapped platen 71. FIG. 16 provides the bottom perspective view of the spring disk 52 and platen 71 assembly 142, again showing the mounting of the orifice 68 against upper flange 62 in counterbore 64, and in this view, showing the outlet 144 of orifice 58.

FIGS. 19–23 provide yet another embodiment of a useful spring disc 503 which is very similar to the configuration shown for spring disc 502 as illustrated in FIGS. 15 and 16. However, the flow conditioning nozzle 120' has an extended outer sidewall 150 due to a recessed upper wall 152 that provides a reduced thickness $T_{152}$ compared to the thickness $T_{154}$ of the outer portion 154 of central disc section 156 of spring disc 503. This provides for a thinner wall $T_{152}$ through which through holes 100' are located. This variable thickness technique allows the part designer to select the desired spring force that spring disc 503 will apply to orifice 58 in a given application by virtue of force F applied from the bottom compressive portion 86 of the high pressure tube 88, as earlier described. Note that nozzle 120 is provided with an interior vertical sidewall 132' height H of adequate distance to achieve the desired results. In one embodiment, where the outside diameter $D_{120}$ is 0.108 inches, and the inside diameter $D_{132'}$ is 0.65 inches, a vertical sidewall height of from between about 0.040 to about 0.060 inches has been found satisfactory, when utilizing an orifice 58 having an outside diameter of 0.078 inches. However, it is to be understood that those of ordinary skill in the art and to whom this specification is addressed will be able to provide many other sizes without undue experimentation in order to achieve desired results for a given application.

Figure 17:
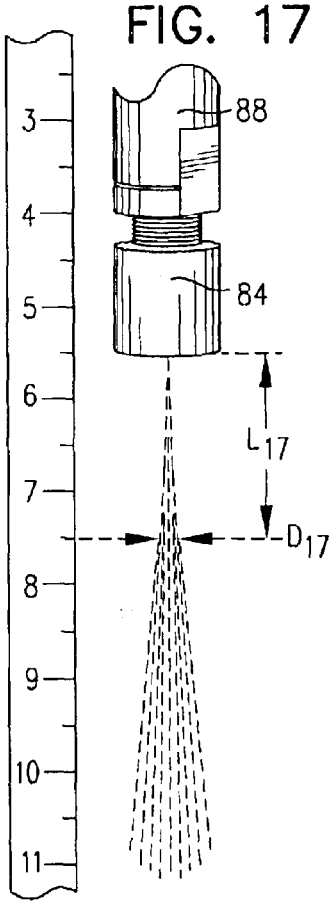
FIGS. 17 and 18 illustrate the use of various flow conditioning nozzles.
Figure 24:
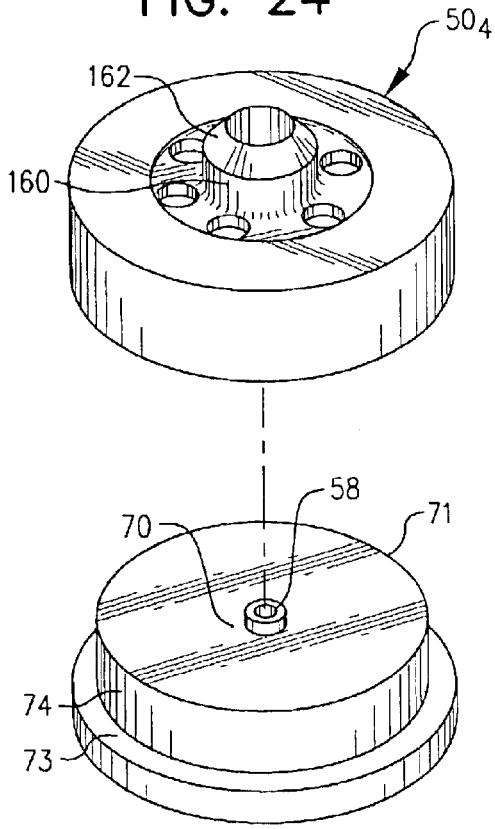
FIG. 24 is yet another embodiment of a spring disc with a flow conditioning nozzle, here showing a de-collimating type flow conditioning nozzle and platen assembly, as well as a flow orifice, as used to provide the de-collimated, spreading waterjet stream illustrated in FIG. 17.

Attention is now directed to FIGS. 24 though 27, wherein another embodiment of a spring disc $\mathbf{50}_4$ is provided, but where a de-collimating flow conditioning nozzle 160 is depicted. Interestingly, the shape of nozzle 160 is very much like the collimating nozzle 120' just illustrated in FIGS. 19–22 above, but the new nozzle 160 utilizes an outwardly and downwardly sloping inlet sidewall 162 between upper end 163 and lower outer end 161. However, a vertically straight sidewall 164 is provided. The sloping inlet wall 162 which slopes outwardly and downwardly at an angle alpha (α) at a preselected angle, which may be adjusted as necessary based on flow rates, pressures, and other process conditions. However, it has been found that an angle alpha (α) of approximately forty five degrees (45°) is useful in creating the results illustrated in FIG. 17. Accordingly, this FIG. 17 shows a waterjet stream $D_{17}$ resulting from the use of a de-collimating flow conditioning nozzle 160 that enables the waterjet stream to be provided in a divergent, diameter $D_{17}$ increasing stream as the downstream working distance $L_{17}$ increases, i.e., the diameter of the waterjet stream $J_{18}$ increases in the downstream direction. This will result in a larger kerf in a cutting application (normally undesirable) but such larger diameter jet has many useful applications where a larger impact area is desirable.

Figure 25:
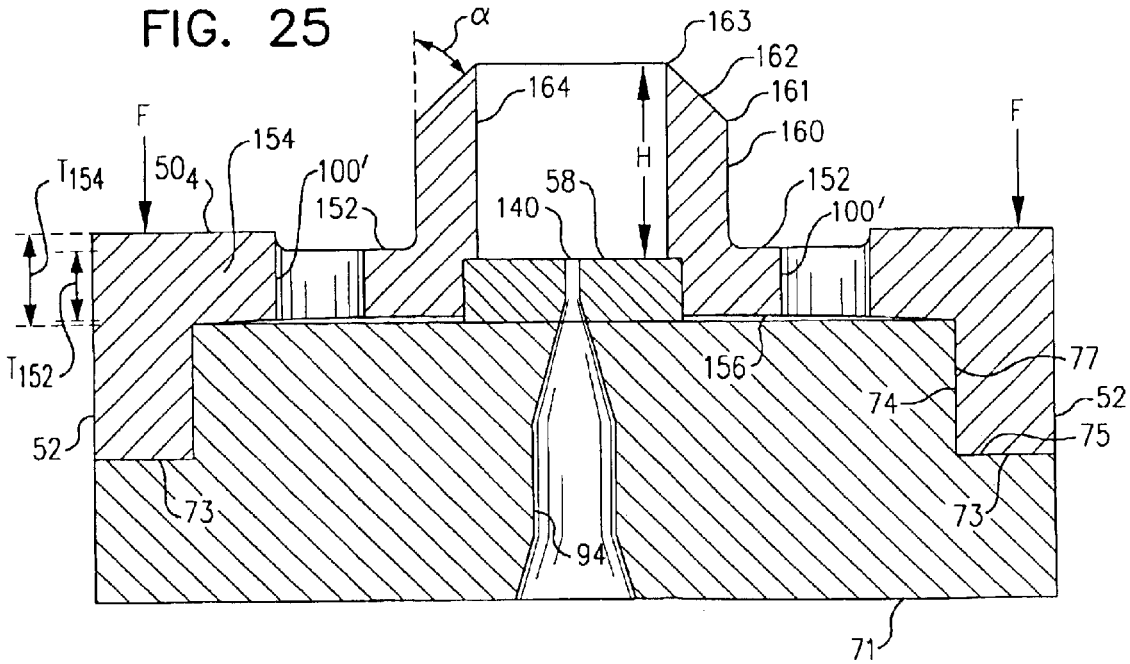
FIG. 25 shows another embodiment of a spring disc and platen assembly, shown using a spring disc with de-collimating flow conditioning nozzle, and including a radially outwardly directed sidewall at the inlet to the flow conditioning nozzle, as well as the use of narrowed thickness spokes for selecting a desired spring force against the orifice.
Figure 26:
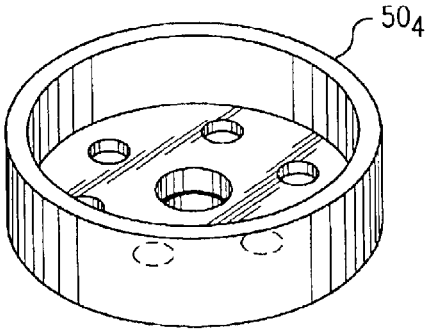
FIG. 26 is a perspective view of the bottom of the spring disc just illustrated in FIG. 25, now showing that in this embodiment, a circular, but slightly concave bottom interior surface with annular outer sidewalls can be utilized to provide a spring disc.
Figure 27:
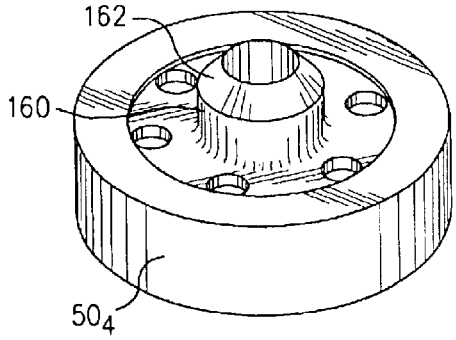
FIG. 27 shows a perspective view of the top of the spring disc just illustrated in FIGS. 25 and 26, now showing in perspective the radially outwardly directed sidewall at the inlet to the flow conditioning nozzle, as well as the use of narrowed thickness spokes for selecting a desired spring force against an orifice.

Also, in FIG. 25, note that the spring disc $\mathbf{50}_4$ provides the use of a thinned, radially outwardly extending spoke region between thin through-holes 100', providing a reduced spoke thickness $T_{152}$ which allows adjustment of spring force exerted against a orifice 58 downward toward a lapped platen surface 70.

Figure 28:
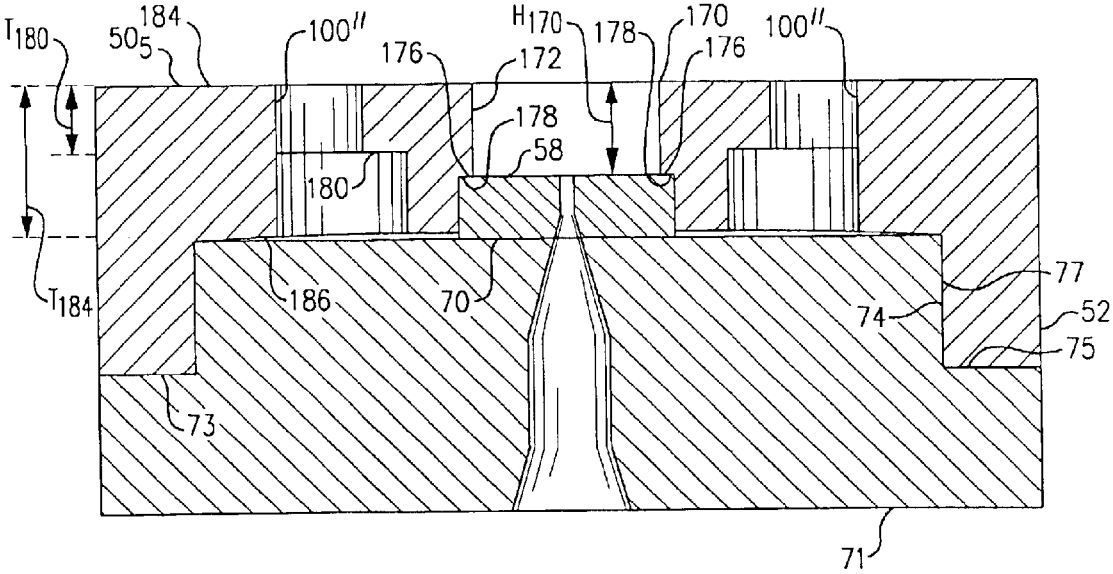
FIG. 28 shows a vertical cross-sectional view of yet another embodiment of a spring disc and platen assembly, including a typical orifice, illustrating the use of a flow conditioning nozzle which is located downstream, flowwise, from the top surface of the spring disc, but which is nevertheless located upstream of the inlet surface of the orifice, as well as showing the use of narrowed thickness spokes for selecting a desired spring force against an orifice.
Figure 29:
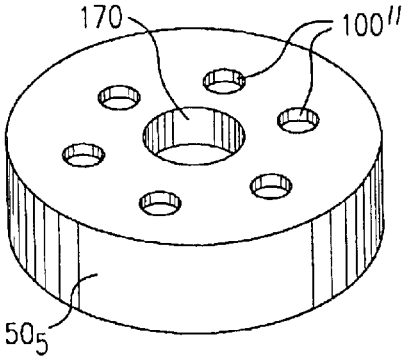
FIG. 29 is a perspective view of the top of one embodiment of a spring disc, here showing the smooth generally circular disc surface, downward through the center of which is a flow conditioning nozzle before the counterbore orifice mounting shoulder.
Figure 30:
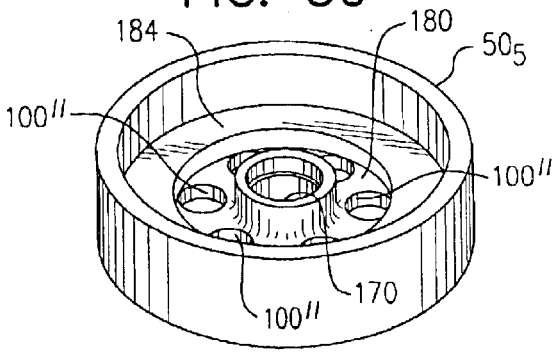
FIG. 30 is a perspective view of the bottom of the embodiment of a spring disc just illustrated in FIGS. 28 and 29, now a first annular interior ring, and inward therefrom, spokes of narrowed vertical cross-section for selection of a desired spring force against an orifice, and including downward through the center a flow conditioning nozzle which includes, toward the lower end thereof, a counterbore orifice mounting shoulder, which applies spring force downward against the orifice, to force it against the lapped platen surface.

Turning now to FIGS. 28, 29, and 30, yet another embodiment is provided of a spring disc assembly showing spring disk 505 and platen 71 in vertical cross section. A top perspective view of spring disk 505 is also shown in FIG. 29, and a bottom perspective view is shown in FIG. 30. In particular, attention is called to yet another flow conditioning nozzle 170 design. This nozzle has interior sidewalls 172 and exterior sidewalls 174. Upper flange portions 176 capture the radial edge 178 of orifice 58 and serve to force orifice 58 toward the upper orifice receiving surface 70 of platen 71. The flow conditioning nozzle 170 is located downstream, flow-wise, from the top surface 180 of the spring disc 505 but is nevertheless located upstream of the inlet surface of the orifice, as well as showing the use of narrowed thickness spokes for selecting a desired spring force against an orifice. The recessed lower wall 180 of central disc portion 182 provides a reduced thickness $T_{180}$ compared to the thickness $T_{184}$ of the outer portion 184 of central disc portion 182 of spring disc $\mathbf{50}_5$. This provides for a thinner wall $T_{180}$ through which through holes 100' are located. This variable thickness technique allows the part designer to select the desired spring force that spring disc $\mathbf{50}_5$ will apply to orifice 58 in a given application by virtue of force F applied from the bottom compressive portion 86 of the high pressure tube 88, as earlier described. In any event, note that through-holes 100' (and equivalents 100 and 100' in earlier embodiments) are necessary for proper hydraulic functioning, i.e., to relieve pressure on the back side of and lower perimeter 190 of orifice 158, so that the hydraulic pressure is not tending to dislodge the orifice 58. In any vent, also note that nozzle 170 is provided with an interior vertical sidewall 172 height $H_{170}$ of adequate distance to achieve the desired results. Note the upper flange portion 178 that amounts to an orifice mounting shoulder for orifice 58, for use in forcing orifice 58 against the lapped surface 70.

Figure 31:
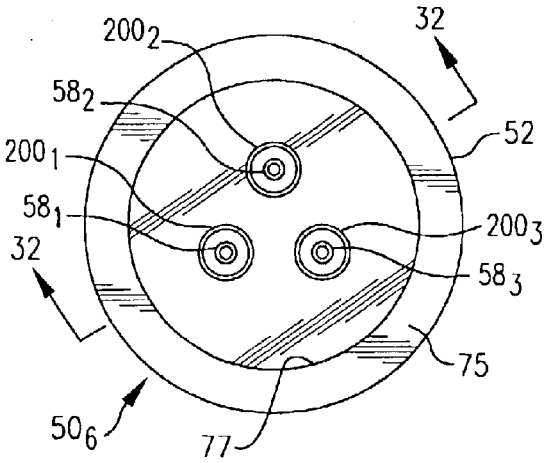
FIG. 31 depicts yet another embodiment of spring disc in which a plurality of orifices are retained by a plurality of counterbores with orifice mounting shoulders; this illustration shows three orifices mounted against the bottom of a spring disc, ready for mounting against a platen.
Figure 32:
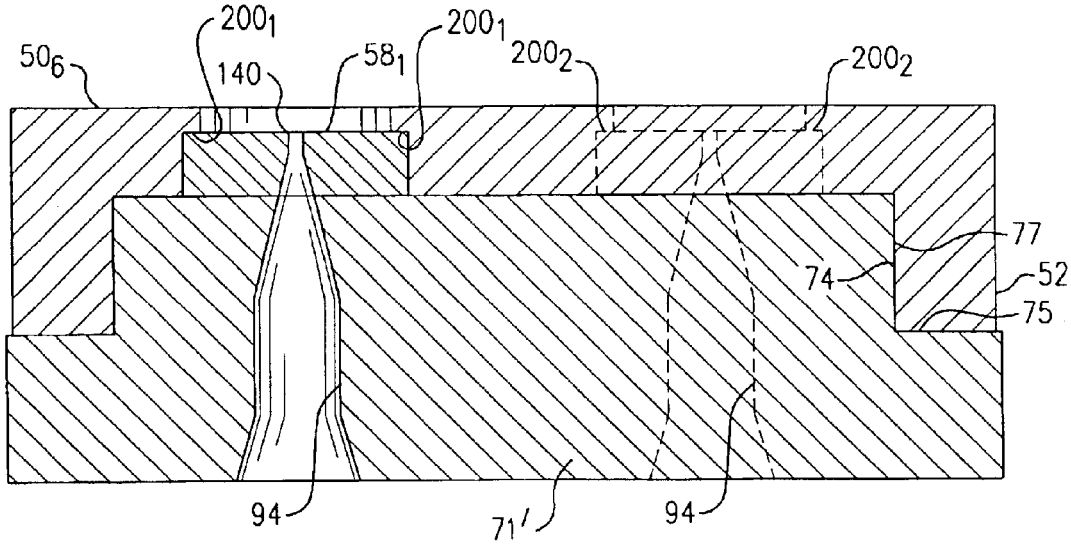
FIG. 32 depicts the spring disc providing a plurality of orifices mounted with orifices in assembly with a suitable platen having a smooth lapped upper surface and multiple water jet receiving passageways therethrough, as just set forth in FIG. 31

Turning now to FIG. 31, yet another embodiment of spring disc $\mathbf{50}_6$ is depicted in which a plurality of orifices $\mathbf{58}_1$, $\mathbf{58}_2$, and $\mathbf{58}_3$ (possibly in a series from $\mathbf{58}_1$ to $\mathbf{58}_N$, where N is a positive integer) are retained by a plurality of counterbores with orifice mounting outer flange shoulders 200. In this FIG. 31, three orifices $\mathbf{58}_1$, $\mathbf{58}_2$, and $\mathbf{58}_3$ have been inserted against the flanges $\mathbf{200}_1$, $\mathbf{200}_2$, and $\mathbf{200}_3$, respectively, in spring disc $\mathbf{50}_6$, ready for mounting against a platen, as depicted in FIG. 32. The platen 71' has a plurality of water jet receiving passageways 94 therethrough. If advisable, each of such orifices 58 may be provided with a flow conditioning nozzle in the manner otherwise set forth herein above.

Figure 33:
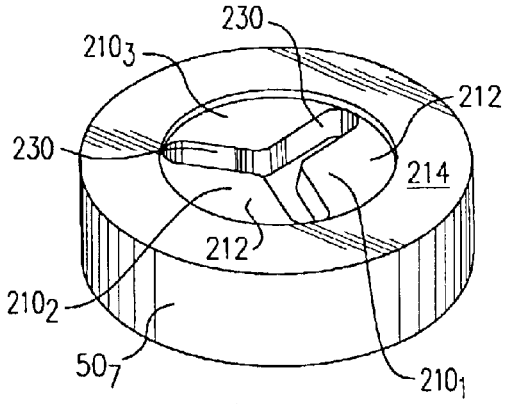
FIG. 33 illustrates a top perspective view of yet another embodiment of a spring disc configuration, here showing the use of a multi-part leafed spring, here shown with three leaves each of which is recessed downwardly, flow-wise, from an annular outer upper surface portion of the spring disc.
Figure 34:
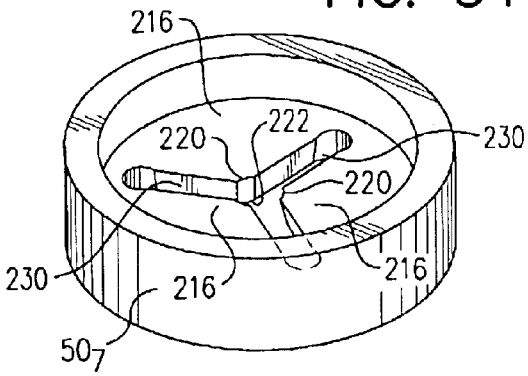
FIG. 34 illustrates a bottom perspective view of the embodiment of a spring disc configuration just illustrated in FIG. 33, showing the use of a multi-part leafed spring, here further illustrating the use of a machined orifice mounting shoulder portion against which an orifice is retained, as well as slots between spring leaf portions.

Finally, attention is directed to FIGS. 33 and 34, which illustrates a top perspective view, and a bottom perspective view, respectively, of yet another embodiment of a spring disc $\mathbf{50}_7$ configuration, here showing the use of a multi-part leafed spring 210, here shown with three leaves $\mathbf{210}_1$, $\mathbf{210}_2$, and $\mathbf{210}_3$, the upper surface 212 of each of which is recessed downwardly, flow-wise, from an annular outer upper surface 214 portion of the spring disc $\mathbf{50}_7$. The bottom 216 of each leaf spring is shown in FIG. 33, each of which additionally provides a machined radially inward segment 220 on which an upper flange segment 222 appears for caging an orifice 58, and each of which segments provide spring force against the orifice 58. Finally, slots 230 are provided, to decrease spring force of each leaf portion.

As generally described herein a method is provided for changing water jet quality between (a) a highly collimated and coherent waterjet flow, and (b) a de-collimated and divergent waterjet flow. The method includes providing a novel waterjet assembly according to one of the types set forth herein, which assembly includes the use of a spring disc and platen. An appropriate spring disc is selected having a selected flow conditioning nozzle. The flow conditioning nozzle may be (a) a collimating, coherent waterjet flow conditioning nozzle, (b) a de-collimating, divergent waterjet flow conditioning nozzle, (c) a neutral flow conditioning nozzle, or (d) a nozzle having slight characteristics toward one direction or the other. The selected flow conditioning nozzle should have a shape selected to provide a preselected waterjet flow condition. Once the flow conditioning nozzle has been selected, then a pressurized reservoir of high pressure water should be generated. An inlet stream portion of the high pressure water is then passed through a spring disc having a selected flow conditioning nozzle. The, the conditioned inlet feed stream must be passed through an orifice to produce a high pressure waterjet. The method may include passing the inlet stream through a collimating flow conditioning nozzle, to produce a coherent waterjet. Alternately, the method may include passing said inlet stream through a de-collimating flow conditioning nozzle, to produce a divergent waterjet.

It is to be appreciated that the various aspects and embodiments of a self-aligning, spring-disk waterjet nozzle assembly, and the method of providing a self sealing waterjet orifice design, are an important improvement in the state of the art. The self-aligning waterjet orifice design described herein is simple, robust, reliable, and susceptible to application in various configurations. Although only a few exemplary embodiments have been described in detail, various details are sufficiently set forth in the drawings and in the specification provided herein to enable one of ordinary skill in the art to make and use the invention(s), which need not be further described by additional writing in this detailed description. Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

What is claimed is:

1. A waterjet orifice assembly comprising:

a) a high pressure tube having an inside diameter defined by opposing sidewalls, a threaded end, and a bottom compressive end portion;

(b) a nozzle cap, said nozzle cap having threads sized and shaped for complementary mating engagement with said threaded end of said high pressure tube, said nozzle cap having an outlet bore, and, adjacent said nozzle cap outlet bore, a platen receiving surface;

(c) a platen, said platen comprising (i) a body, (ii) a smooth upper orifice receiving surface, and (iii) a lower end portion sized and shaped for complementary mating engagement with said platen receiving surface in said nozzle cap;

(d) a spring disk, said spring disk having and upstream side with a top surface and an downstream side with a bottom surface, and an overall diameter larger than the diameter of said central bore in said high pressure tubing, said spring disk comprising (i) a generally circular disc portion, (ii) at least one counterbore through said circular disk portion, said at least one counterbore defined by sidewall portions, said at least one counterbore of preselected height and diameter, said at least one counterbore further comprising an upper flange portion, (iii) an annular ring sidewall portion, said annular ring sidewall portion extending downwardly from said generally circular disc portion, and (iv) a flow conditioning nozzle, said flow conditioning nozzle located upstream of said upper flange portion;

(e) at least one orifice, said at least one orifice having a central bore sized and shaped for escapement of high pressure fluid therethrough, said at least one orifice having a height at least slightly larger than said preselected height of one of said at least one counterbores in said spring disk, said at least one orifice removably mounted in said at least one counterbore of said spring disk; and (f) wherein said spring disk is clamped between said bottom compressive end portion of said high pressure inlet tube and said platen, which said platen is compressed by said platen receiving surface of said nozzle cap, so as to force said at least one orifice downward against said upper surface of said platen.

2. The apparatus as set forth in claim 1, wherein a single orifice is provided, and wherein said outlet bore of said nozzle cap is concentric with said central bore of said high pressure tube.

3. The apparatus as set forth in claim 1, wherein a single orifice is provided, and wherein said at least one counterbore of said spring disk is concentric with said central bore of said high pressure tube.

4. The apparatus as set forth in claim 1, wherein, said spring disk is sufficiently flexible so as to avoid crushing of said orifice when said nozzle cap is tightened to secure said nozzle cap to said high pressure tube.

5. The apparatus as set forth in claim 1, wherein said orifice has an inlet side having an inlet side area, and an outlet side having an outlet side land area which sits against said upper surface of said platen, and wherein hydrostatic pressure is contained within said high pressure tube and transmitted to said inlet side area of said orifice, and wherein force is transmitted through said orifice to said outlet side land area of said orifice, and wherein said inlet side area is larger than said outlet side land area of said orifice, so that sealing of said orifice against said upper surface of said platen is achieved.

6. The apparatus as set forth in claim 1, or in claim 5, wherein said upper surface of said platen comprises a lapped surface.

7. The apparatus as set forth in claim 1, wherein said spring disk comprises a plurality of counterbores, each one of said at least one counterbores comprising an upper flange portion, and wherein an orifice is provided in secure mounted engagement in an upper flange portion in each one of said plurality of counterbores.

8. The apparatus as set forth in claim 1, wherein said spring disk is sufficiently flexible so as to avoid crushing of said orifice when said nozzle cap is tightened to secure said nozzle cap to said high pressure tube.

9. The apparatus as set forth in claim 1, wherein said spring disc comprises at least three leaf spring portions.

10. A waterjet orifice assembly comprising:

(a) a high pressure tube having a inside diameter defined by opposing sidewalls, and a threaded end having a bottom compressive surface portion;

(b) a nozzle cap, said nozzle cap having threads sized and shaped for complementary mating engagement with said threaded end of said high pressure tube, said nozzle cap having an outlet bore, and, adjacent said nozzle cap outlet bore, an interior counterbore having a platen receiving surface;

(c) a platen, said platen comprising (i) a body, (ii) a smooth upper orifice receiving surface, and (iii) a lower end portion sized and shaped for complementary mating engagement with said platen receiving surface in said nozzle cap;

(d) a spring disk, said spring disk having and upstream side with a top surface and an downstream side with a bottom surface, and an overall diameter larger than the diameter of said central bore in said high pressure tubing, said spring disk comprising (i) a generally circular disc portion, (ii) at least one counterbore through said circular disk portion, said at least one counterbore defined by sidewall portions, said at least one counterbore of preselected height and diameter, said at least one counterbore further comprising an upper flange portion, (iii) an annular ring sidewall portion, said annular ring sidewall portion extending downwardly from said generally circular disc portion;

(e) an orifice, said orifice having a central bore sized and shaped for escapement of high pressure fluid therethrough, said orifice having a height at least slightly larger than said preselected height than a selected one of said at least one counterbores of said spring disc, said orifice removably mounted in said at least one counterbore; and (f) wherein said spring disk is clamped between said bottom compressive end portion of said high pressure inlet tube and said platen, which said platen is compressed by said platen receiving surface of said nozzle cap, so as to force said at least one orifice downward against said upper surface of said platen.

11. The apparatus as set forth in claim 10, wherein a single orifice is provided, and wherein said outlet bore of said nozzle cap is concentric with said high pressure tube.

12. The apparatus as set forth in claim 1 or in claim 10, wherein said spring disk is sufficiently flexible so as to prevent the crushing of said orifice when said nozzle cap is tightened to secure said nozzle cap to said high pressure tube.

13. The apparatus as set forth in claim 10, wherein said orifice has an inlet side having an inlet side area, and an outlet size having an outlet side land area which sits against said upper receiving surface of said platen, and wherein hydrostatic pressure is contained within said high pressure tube and is transmitted to said inlet side area of said orifice, and wherein such force is transmitted through said orifice to said outlet side land area of said orifice, and wherein said inlet side area is larger than said outlet side land area of said orifice, so that sealing of said orifice against said upper receiving surface said platen is achieved.

14. The apparatus as set forth in claim 1, or in claim 10, wherein said upper receiving surface of said platen comprises a lapped surface.

15. The apparatus as set forth in claim 10, wherein (a) said spring disk comprises a plurality of counterbores, and wherein an orifice is provided in interfitting mounted engagement in each one of said plurality of counterbores;

(b) said platen comprises a plurality of platen apertures therethrough, said platen apertures each axially centered with one of said orifices; and (c) said nozzle cap comprises a plurality of outlet bores therethrough, said outlet bores each axially centered with one of said orifices and a companion one of said platen apertures.

16. The apparatus as set forth in claim 1, or in claim 10, wherein said spring disk is removably replaceable.

17. The apparatus as set forth in claim 1, or claim 10, wherein said orifice is removably replaceable.

18. The apparatus as set forth in claim 1, or claim 10, wherein said platen is removably replaceable.

19. The apparatus as set forth in claim 1, or in claim 10, wherein said platen comprises an integral cylindrical base, and an annular shoulder, and wherein said spring disk further comprises an annular shoulder, and wherein said spring disk compresses said orifice against said upper orifice receiving surface of said platen, and wherein said spring disk and said platen are compressed in an operating position between said nozzle cap and said compressive end of said high pressure tube.

20. The apparatus as set forth in claim 1 or in claim 10, wherein said generally circularly disc portion of said spring disk comprises (a) art outer wall region having a first thickness, and (b) an inner spoke region having a second thickness.

21. The apparatus as set forth in claim 20, wherein said first thickness and said second thickness of said generally circular disc portion are substantially identical.

22. The apparatus as set forth in claim 20, wherein said first thickness is larger than said second thickness, so that the thickness of said generally circular disc portion is less in said inner spoke region.

23. The apparatus as set forth in claim 10, wherein said spring disk further comprises a flow conditioning nozzle, said flow conditioning nozzle located on the upstream side of said upper flange portion.

24. The apparatus as set forth in claim 1 or claim 23, wherein said flow conditioning nozzle protrudes above said top surface of said spring disk.

25. The apparatus as set forth in claim 24, wherein said flow conditioning nozzle comprises an upper end, said upper end having outwardly sloping inlet wall portions.

26. The apparatus as set forth in claim 25, wherein said outward sloping inlet wall portions are sloped downward at an angle alpha.

27. The apparatus as set forth in claim 26, wherein said angle alpha is equal to about forty five degrees.

28. The apparatus as set forth in claim 24, wherein said flow conditioning nozzle comprises an upper end, said upper end having inwardly sloping inlet wall portions.

29. The apparatus as set forth in claim 28, wherein said inwardly sloping inlet wall portions are sloped downward and inward at an angle beta.

30. The apparatus as set forth in claim 29, wherein said angle beta is equal to about forty five degrees.

31. The apparatus as set forth in claim 1 or claim 23, wherein said flow conditioning nozzle does not protrude above said top surface of said spring disk.

32. The apparatus as set forth in claim 1 or in claim 10, wherein in said flow conditioning nozzle is shaped and sized to provide a collimating, coherent waterjet.

33. The apparatus as set forth in claim 1 or in claim 10, wherein said flow conditioning nozzle is sized and shaped to provide a de-collimating, rapidly spreading waterjet.

34. A method of changing water jet quality to or from (a) a highly collimated and coherent waterjet flow, with (b) a de-collimated and divergent waterjet flow, said method comprising:

(a) providing the waterjet assembly set forth in claim 8;

(b) providing a spring disc further comprising a selected flow conditioning nozzle, said flow conditioning nozzle comprising (a) a collimating, coherent waterjet flow conditioning nozzle, or (b) a de-collimating, divergent waterjet flow conditioning nozzle.

35. The method as set forth in claim 34, wherein said flow conditioning nozzle comprises a shape selected to provide a preselected waterjet flow condition.

36. A waterjet orifice assembly comprising:

(a) a high pressure tube having an inside diameter defined by opposing sidewalls, a threaded end, and a bottom compressive end portion;

(b) a nozzle cap, said nozzle cap having threads sized and shaped for complementary mating engagement with said threaded end of said high pressure tube, said nozzle cap having an outlet bore, and, adjacent said nozzle cap outlet bore, a platen receiving surface;

(c) a platen, said platen comprising (i) a body, (ii) a smooth upper orifice receiving surface, and (iii) a lower end portion sized and shaped for complementary mating engagement with said platen receiving surface in said nozzle cap;

(d) a spring disk, said spring disk having and upstream side with a top surface and an downstream side with a bottom surface, and an overall diameter larger than the diameter of said central bore in said high pressure tubing, said spring disk comprising (i) a generally circular disc portion, said generally circular disc portion having a plurality of inwardly extending slots therein which divide said disc portion into multiple leaf spring portions, (ii) at least one counterbore through said circular disk portion, said at least one counterbore comprising arcuate portions corresponding to said multiple leaf spring portions, said arcuate portions separated by a gap defined by said inwardly extending slots, said arcuate portions of said at least one counterbore defined by sidewall portions, said arcuate portions of said at least one counterbore of preselected height and diameter, said arcuate portions of said at least one counterbore further comprising an upper flange portion, (iii) a ring sidewall portion, said ring sidewall portion extending downwardly to an upper flange segment, and (iv) a flow conditioning nozzle, said flow conditioning nozzle located upstream of said upper flange portion;

(e) at least one orifice, said at least one orifice having a central bore sized and shaped for escapement of high pressure fluid therethrough, said at least one orifice having a height at least slightly larger than said preselected height of one of said at least one counterbores in said spring disk, said at least one orifice removably mounted at said upper flange segment in said at least one counterbore of said spring disk; and (f) wherein said spring disk is clamped between said bottom compressive end portion of said high pressure inlet tube and said platen, which said platen is compressed by said platen receiving surface of said nozzle cap, so as to force said at least one orifice downward against said upper surface of said platen.

37. The apparatus as set forth in claim 36, wherein a single orifice is provided, and wherein said outlet bore of said nozzle cap is concentric with said central bore of said high pressure tube.

38. The apparatus as set forth in claim 36, wherein a single orifice is provided, and wherein said at least one counterbore of said spring disk is concentric with said central bore of said high pressure tube.

* * * * *